US007931118B1

(12) United States Patent
Cronhelm

(10) Patent No.: US 7,931,118 B1
(45) Date of Patent: Apr. 26, 2011

(54) BAFFLE FOR SOUND SUPPRESSION

(75) Inventor: Peter William Cronhelm, Calgary (CA)

(73) Assignee: Peter Cronhelm, Calgary (CA)

( * ) Notice: Subject to any disclaimer, the term of this patent is extended or adjusted under 35 U.S.C. 154(b) by 0 days.

(21) Appl. No.: 12/662,697

(22) Filed: Apr. 29, 2010

Related U.S. Application Data

(60) Provisional application No. 61/174,183, filed on Apr. 30, 2009.

(51) Int. Cl.
*F41A 21/30* (2006.01)
*F41A 21/32* (2006.01)
*F41A 21/34* (2006.01)
*F41A 21/36* (2006.01)

(52) U.S. Cl. ..... 181/223; 89/14.4

(58) Field of Classification Search ..... 181/223, 181/264, 269, 270, 272, 250; 89/14.4, 14.2, 89/14.3
See application file for complete search history.

(56) References Cited

U.S. PATENT DOCUMENTS 1,066,898 A * 7/1913 Gray ..... 181/223
1,173,687 A * 2/1916 Thompson ..... 89/14.4
3,492,912 A * 2/1970 Ashbrook ..... 89/14.3
3,748,956 A * 7/1973 Hubner ..... 89/14.4
3,786,895 A * 1/1974 Perrine ..... 181/223
4,291,610 A 9/1981 Waiser
4,576,083 A * 3/1986 Seberger, Jr. ..... 89/14.4
4,588,043 A 5/1986 Finn
4,907,488 A 3/1990 Seberger
5,164,535 A 11/1992 Leasure
5,385,079 A * 1/1995 Cave ..... 89/14.3
5,476,028 A * 12/1995 Seberger ..... 89/14.3
6,079,311 A * 6/2000 O'Quinn et al. ..... 89/14.4
D435,623 S * 12/2000 Andrews et al. ..... D22/108
6,257,147 B1 * 7/2001 Davies ..... 102/439
6,308,609 B1 * 10/2001 Davies ..... 89/14.4
6,374,718 B1 * 4/2002 Rescigno et al. ..... 89/14.4
6,575,074 B1 * 6/2003 Gaddini ..... 89/14.4
6,796,214 B2 * 9/2004 Hausken et al. ..... 89/14.4
7,073,426 B1 7/2006 White
7,237,467 B1 7/2007 Melton
7,308,967 B1 * 12/2007 Hoel ..... 181/223
7,412,917 B2 * 8/2008 Vais ..... 89/14.4
7,587,969 B2 * 9/2009 Silvers ..... 89/14.4
7,600,606 B2 * 10/2009 Brittingham ..... 181/223
7,789,008 B2 * 9/2010 Petersen ..... 89/14.4

* cited by examiner

*Primary Examiner* — Edgardo San Martin

(57) ABSTRACT

A baffle for use in a sound suppressor for a firearm utilizing proximal and distal faces with at least one joining wall positioned between the proximal and distal faces, and forming two expansion chambers between the proximal and distal faces. The joining wall has a bore hole and at least one opening in the wall itself and at least one opening from the bore hole into at least one of the expansion chambers positioned between the proximal and distal faces of the baffle. The joining wall may be either curvilinear, curvilinear stepped, planar or angled in shape. Openings are provided on the proximal face and the distal face of the baffle. At least one face of the baffle is either flat, curvilinear, curvilinear stepped, or asymmetrical to the axis of the baffle.

13 Claims, 19 Drawing Sheets

BAFFLE FOR SOUND SUPPRESSION

REFERENCE TO RELATED APPLICATION

This non-provisional patent application claims priority to provisional patent application No. 61/174,183 filed Apr. 30, 2009.

BACKGROUND OF THE INVENTION

1. Field of the Invention

The present invention relates broadly to firearms and the reduction of noise, flash and recoil resulting from the discharge of firearms. More specifically, this invention relates to a baffle for use in sound suppressors for firearms.

2. Description of the Related Art

Firearms typically discharge noise and gases into the atmosphere, when fired, which may be harmful or offensive to the shooter and/or to others within the general vicinity. As a result various suppression devices have been devised in order to attempt to solve this problem. These sound suppressor devices may feature baffles that use some form of asymmetry while others may feature the use of baffles that are basically symmetrical. While asymmetrical baffles typically produce high levels of turbulence within the sound suppressor, which aids in producing high levels of sound and flash reduction, asymmetrical baffles may result in some detrimental effects on the accuracy of the host firearm. This particularly applies to center fire rifles, and subsequently there needs to be some degree of symmetry in the center fire rifle suppressor to compensate for the possible detrimental effects on accuracy. This may involve the use of symmetrical baffles with asymmetrical baffles as disclosed by U.S. Pat. No. 7,073,426 (White). While the asymmetrical baffles disclosed by White result in good sound reduction, the baffles themselves are positioned asymmetrically or at an angle less than or greater than ninety degrees to the bore axis of the sound suppressor. This does result in some inefficiencies and problems during the manufacturing process.

Other asymmetrical baffles use some form of asymmetry at the bore without the baffle itself being positioned at an angle to the bore axis. The asymmetry may be in the form of a slanted sidewall as disclosed in U.S. Pat. Nos. 4,588,043 (Finn), beveled diversion passages in 5,164,535 (Leasure), or an elongated gas aperture in 6,575,074 (Gaddini). Practiced art includes the use of a shear cut at the bore of a conical or semi- or quasi-conical baffle, the shear cut being a section of the baffle being cut away at the bore hole, or cuts at the bore of a baffle, such as scallops, recesses, or scoops. The concept behind the use of such asymmetrical surfaces is that the surfaces divert gases away from the bore axis. The asymmetry is usually positioned on the proximal or rear face of the baffle where the gas pressures are higher. The more effective the diversion, and subsequent creation of turbulence due to the diverting gases impinging upon other surfaces within the suppressor, generally the suppressor is more efficient with regards to sound reduction. The problem is that with the asymmetry being on the proximal or rear face of the baffle, this affects the accuracy when used with center fire rifles.

The symmetrical baffle has been used extensively since sound suppressors for firearms first appeared, and the common forms of a symmetrical baffle include the truncated cone or conical baffle, and various disc shaped baffles that may be parabolic, quasi-parabolic or hemispherical, or simply flat. While the performance of the flat symmetrical baffle is usually quite poor, other symmetrical baffles such as those described are much more effective. The baffles disclosed in U.S. Pat. Nos. 4,576,083 and 4,907,488 (Seberger) and 7,237,467 (Melton) are indicative of the state-of-the-art in symmetrical baffles, and provide significant reduction. Such baffles may have some drawbacks including increased weight over that of asymmetrical baffles.

A major problem with both asymmetrical and symmetrical baffles is that varying the degree of asymmetry or symmetry does not result in significant improvements in sound reduction or increased performance levels within present suppressors. There appears to be so-called "sweet spots" with both types of baffles where each form of baffle provides very good results. Changing these "sweet spots" to gain an advantage such as reduced length or diameter of the suppressor often results in decreased performance levels which is not desirable.

BRIEF SUMMARY OF THE INVENTION

The present invention provides unique improvements to firearm sound suppressor baffles comprising: a baffle that utilizes proximal and distal faces joined together by a wall; a baffle that utilizes a joining wall that provides enhanced gas diversion from the bore axis through the provision of at least one opening that is positioned in the joining wall; a baffle that utilizes proximal and distal faces joined together by a joining wall, whereby sections of the discrete proximal and distal faces are removed; and a baffle that utilizes proximal and distal faces joined together by a joining wall, whereby the thickness and/or the length of the joining wall may vary.

The present invention discloses baffles which may be used in a discrete form with some form of separate spacer between the baffles or may be secured directly to the tube or housing of the suppressor, thereby increasing manufacturing options. In another form, the baffles may be used in a monolithic form whereby a number of baffles are machined, injection molded or cast to form a baffle stack that is of a one-piece construction. To enhance the performance, the baffles may be positioned such that one baffle is angularly rotated around the bore axis from the previous baffle in the baffle stack. The baffles are reasonably lightweight but at the same time are also quite structurally strong. To further enhance the performance, certain and/or specific features of the baffle may be varied, resulting in the baffle having the ability to be tuned to the caliber of the host firearm. The present invention may be used to provide an improved sound suppressor baffle that achieves good levels of sound reduction yet at the same time be able to be tuned to enhance sound reduction and the reduction of sound frequency.

An improvement in the present invention includes a baffle that uses a proximal or rear face and a distal or front face that are joined together by a joining wall. The joining wall may formed by the removal of material between the two faces, using machining processes or other manufacturing means. In the case of a curvilinear joining wall, this may be formed by the removal of material between the two faces where the top and bottom surfaces of the wall are curvilinear. Two expansion chambers are thus formed between the two faces by the removal of material between the two faces, and the volume of these expansion chambers will vary accordingly to the variation in the shape of the section joining the two faces.

While the curvilinear joining wall may be positioned so there is an equal thickness of material on either side of the bore hole, in another embodiment the curvilinear joining wall may be positioned so that there is more material on one side of the bore hole than the other side of the bore hole. This will result in a variation in the thickness of the curvilinear joining wall, and this may be dependent upon the caliber and type of firearm used with the suppressor. Due to this variation in thickness, the curvilinear joining wall may be positioned eccentrically to the bore axis, and thus the top and bottom surfaces may intersect the bore hole of the baffle, thus forming openings at the top and bottom of the bore hole. These openings may vary in size by varying the length and position of the curvilinear surfaces in relation to the bore hole of the baffle.

In other embodiments, the proximal and distal faces may be joined by a curvilinear stepped or graduated joining wall, a wall that has angled surfaces, or a planar joining wall. Both the proximal and/or distal faces may be either curvilinear, curvilinear stepped, asymmetric to the axis of the bore or flat and may have sections that are bent either forward or backward. The curve and/or bend may occur at any position from the center of the bore to the top or bottom outside edge of the face.

Another improvement is the provision of a baffle that uses a proximal or rear face and a distal or front face that are joined together by a joining wall, and whereby a plurality of slots, slits or holes are positioned in the joining wall. These slots, slits or holes may be at ninety degrees to the bore axis of the baffle or the angle may vary. These slots, slits or holes are positioned in the joining wall, and may be positioned between the bore hole of the baffle and about or near the outer edge of the joining wall. These slots, slits or holes are provided in addition to the existing gas vent holes in the joining wall at the bore of the baffle.

A further unique improvement is the provision of a baffle that uses a proximal or rear face and a distal or front face that are joined together by a joining wall, and whereby sections of the proximal and distal faces are removed through the use of openings. The size of the openings may be large or small. As a result of the size of these openings, the areas of the two expansion chambers between the two faces of the baffles may be increased by a minor or major amount.

Another improvement is the provision of a baffle that uses a proximal or rear face and a distal or front face that are joined together by a joining wall, and whereby the thickness of the joining wall is varied through the removal of material from the joining wall by the use of cuts positioned transversely to the bore axis of the baffle. The use of a plurality of cuts will result in the joining wall having a notched or staggered appearance when viewed side on. The use of a curvilinear stepped joining wall will result in the section joining the proximal and distal faces having a stepped and curved appearance when viewed side on. The openings formed at the bore by the length and position of the cuts will vary in length and volume.

The present invention holds significant improvements and serves as a baffle for sound suppression. These and other features, aspects, and advantages of the present invention will become better understood with reference to the following drawings and description.

BRIEF DESCRIPTION OF THE DRAWINGS

The various embodiments of the present invention will hereinafter be described in conjunction with the appended drawings, wherein like designations denote like elements.

DETAILED DESCRIPTION

Figure 1:
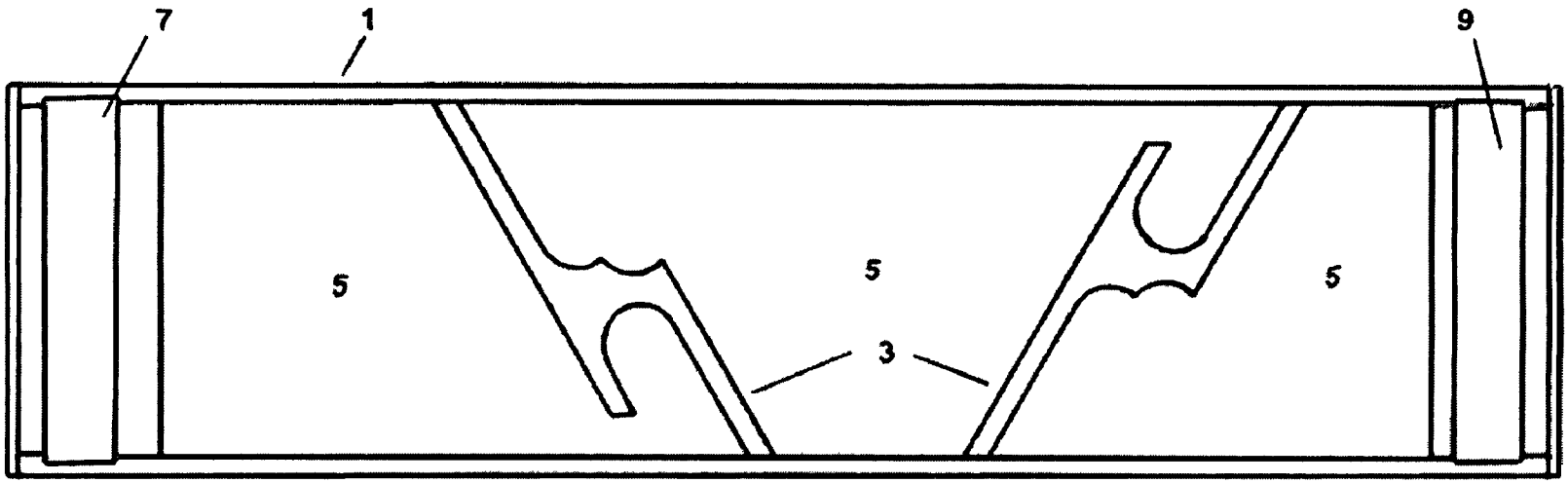
FIG. 1 shows a perspective cross-sectional view, illustrating a suppressor with baffles positioned along an interior of a housing, according to an embodiment of the present invention.

Referring now to FIG. 1 showing a perspective cross-sectional view, illustrating a sound suppressor with baffles 3 positioned along an interior of housing 1, according to an embodiment of the present invention. The sound suppressor consists of a hollow cylindrical housing 1, with spaced baffle elements 3, creating a series of expansion chambers 5, between the baffles 3. An entrance end cap 7 and an exit end cap 9 are secured to the housing 1 preferably by screw threads, by welding or other suitable securing means.

Figure 1B:
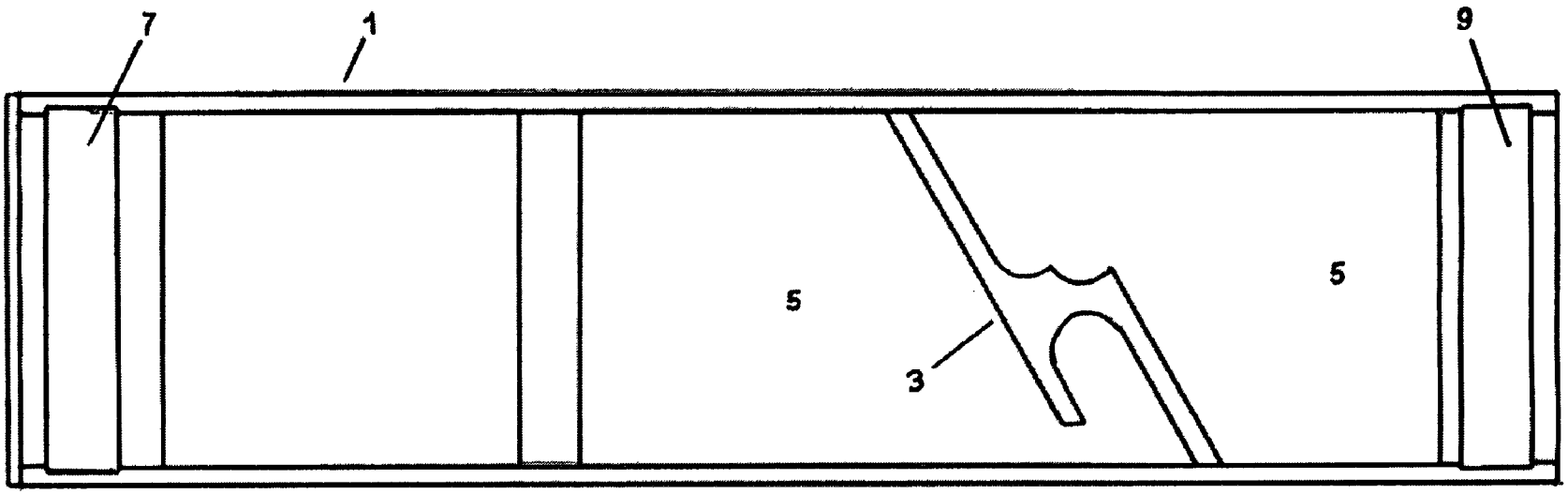
FIG. 1*b* shows a perspective cross-sectional view, illustrating another embodiment of the suppressor with a baffle positioned along the interior of the housing, according to the present invention.

Referring now to FIG. 1*b* showing a perspective cross-sectional view, illustrating another embodiment of the suppressor with baffle 3 positioned along the interior of housing 1, according to the present invention. In this particular embodiment a single baffle 3 may be used to bifurcate expansion chamber(s) 5. Entrance end cap 7 and exit end cap 9 are secured to the housing 1, as also shown and discussed in FIG. 1. FIG. 1*b* shows a flat and symmetrical blast baffle 3 being used ahead of and in conjunction with the slanted baffles 3 of the present invention. Traditionally non-symmetrical suppressors, when used in combination with centerfire rifles, have caused severe problems with respect to accuracy. To improve the accuracy of these rifles, this particular embodiment of baffle(s) 3 may be used in conjunction with a flat and/or symmetrical blast baffle 3, as shown. In this manner, the present invention serves to increase firearm shooting accuracy.

Figure 2:
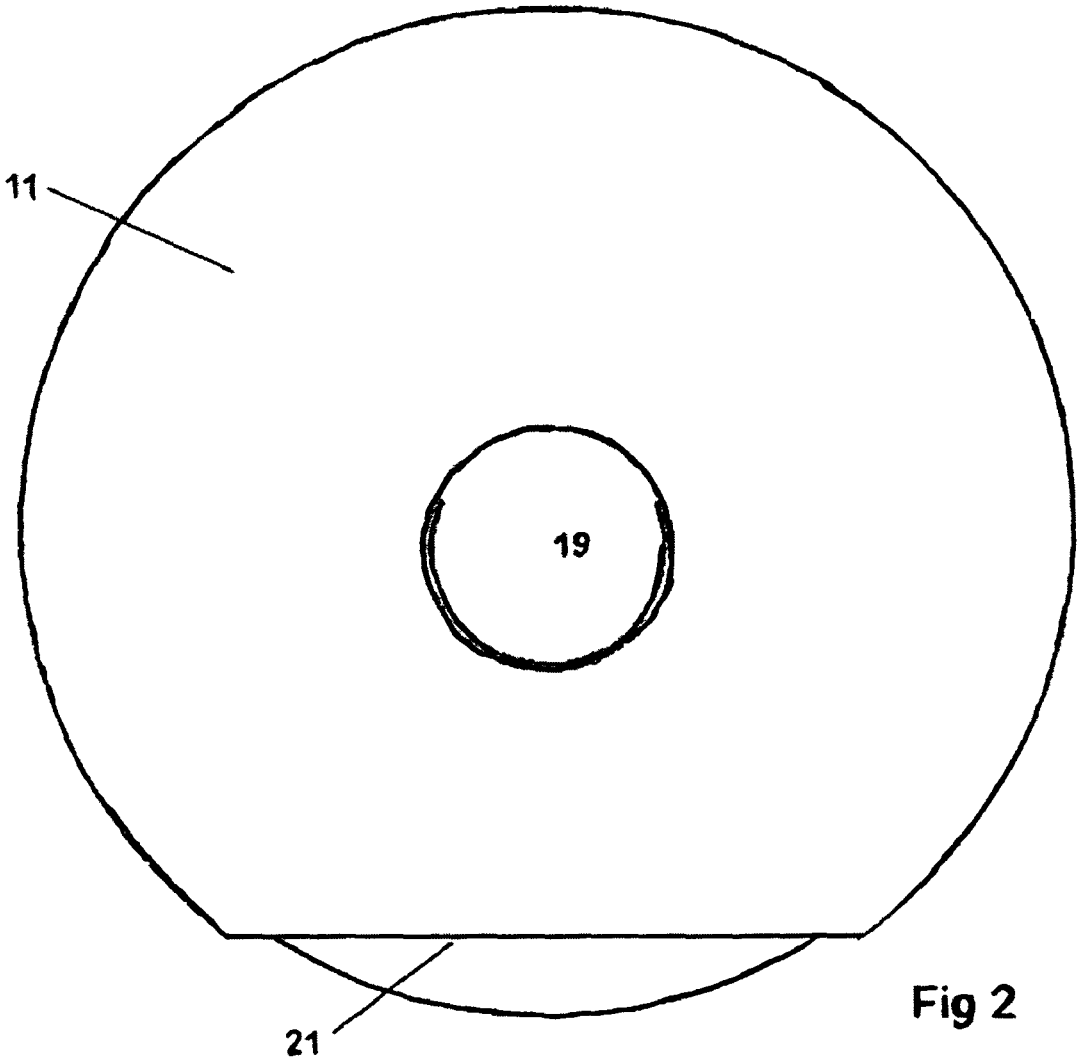
FIG. 2 is a perspective view, illustrating a rear face view of the baffle, according to an embodiment of the present invention of FIG. 1.
Figure 3:
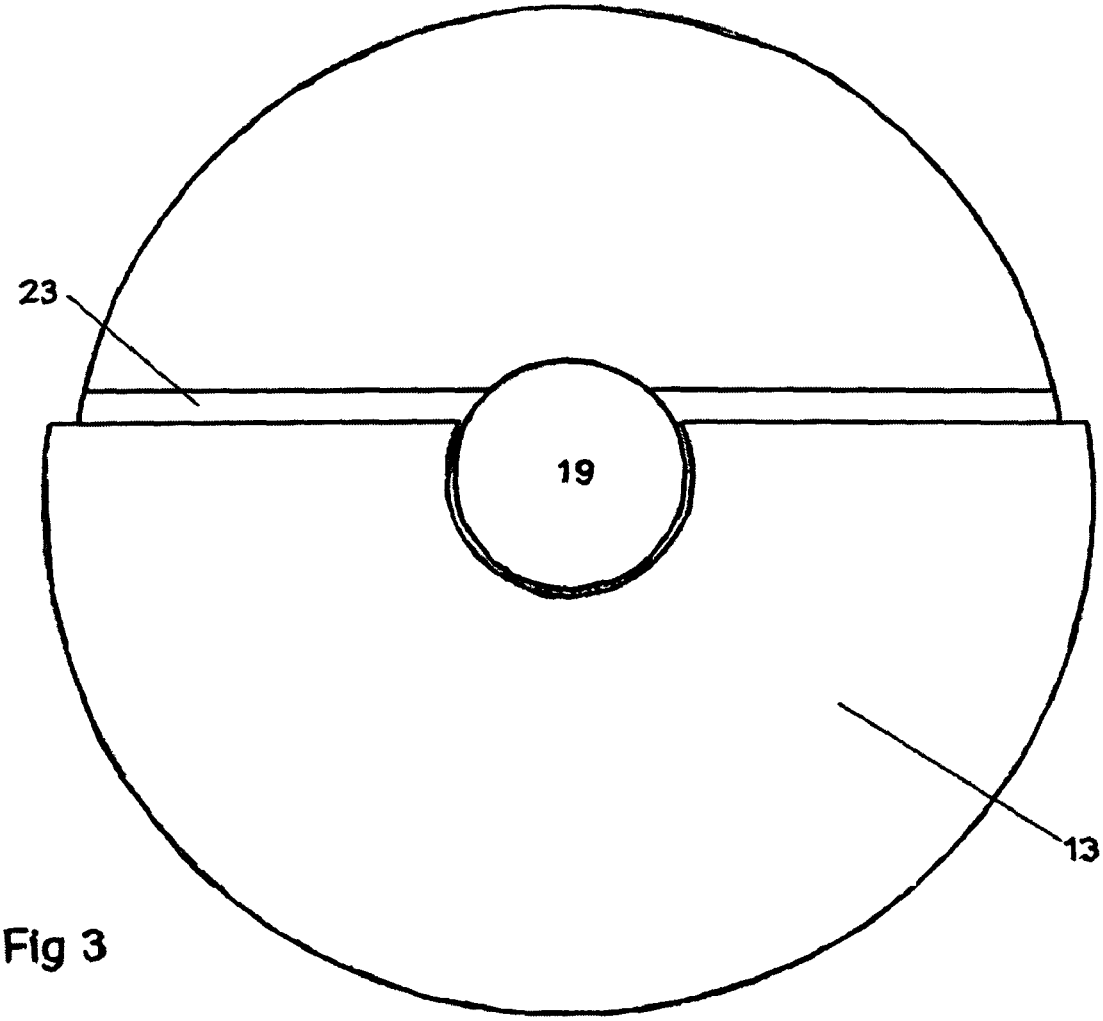
FIG. 3 is a perspective view, illustrating a front face view of the baffle, according to an embodiment of the present invention of FIG. 1.
Figure 4:
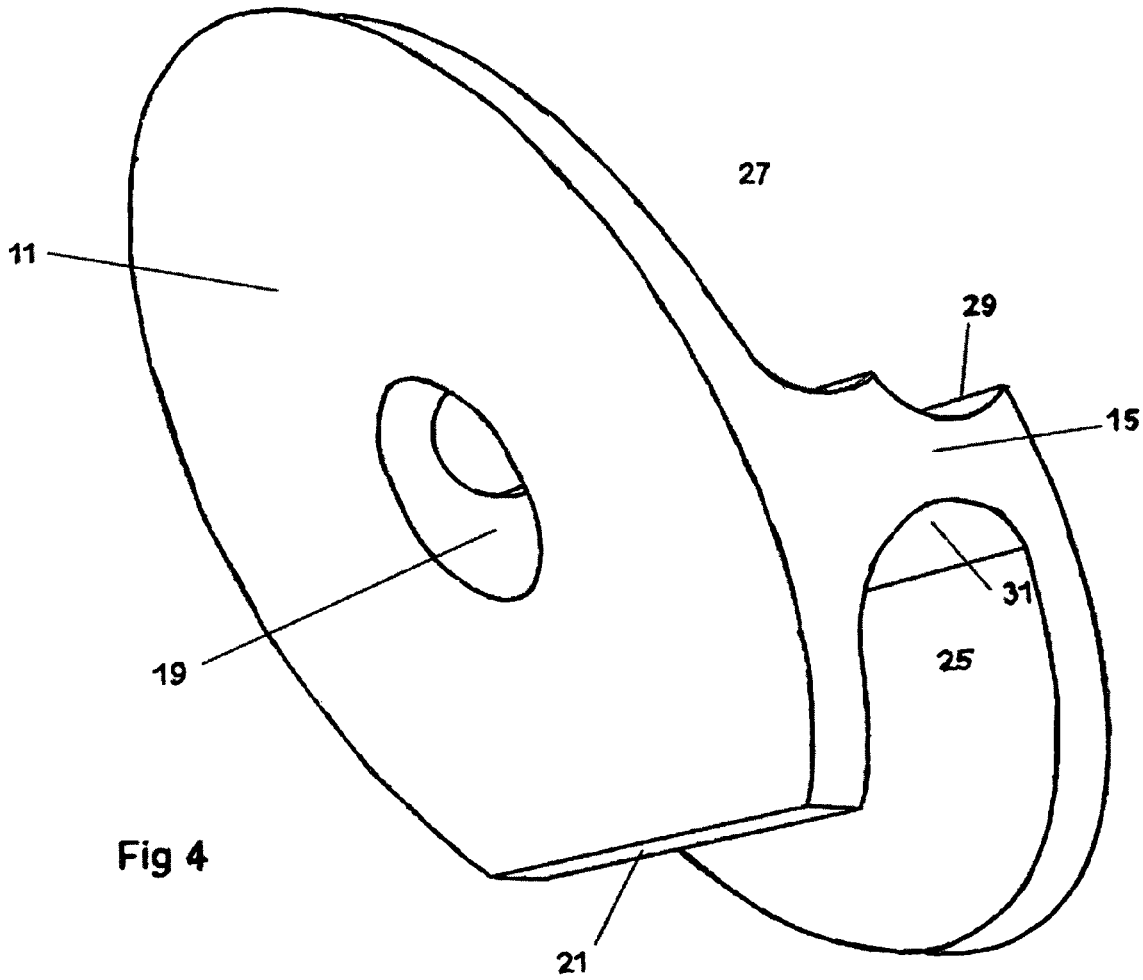
FIG. 4 is a perspective view, illustrating a rear face perspective view of the baffle, according to an embodiment of the present invention of FIG. 1.
Figure 5:
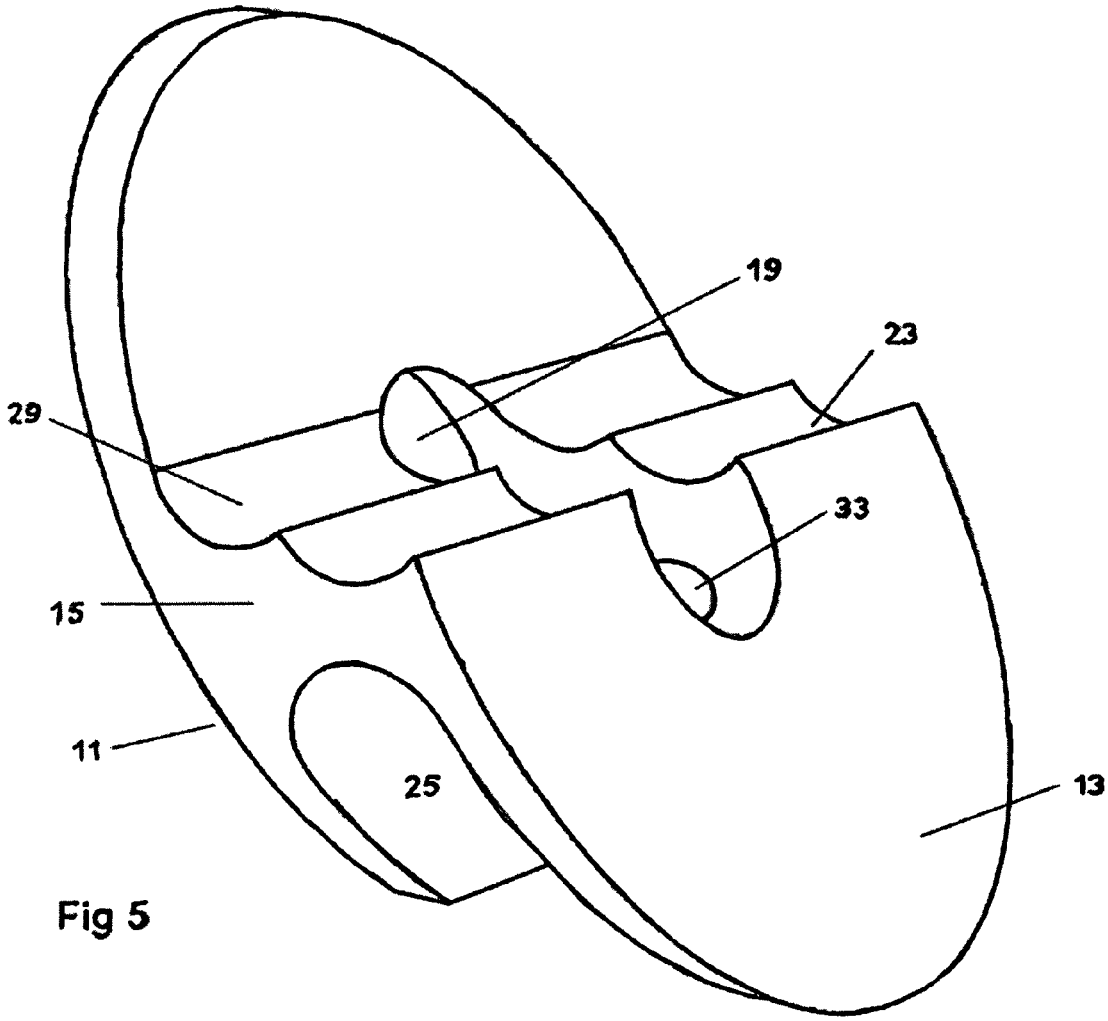
FIG. 5 is a perspective view, illustrating a front face perspective view of the baffle, according to an embodiment of the present invention of FIG. 1.
Figure 6:
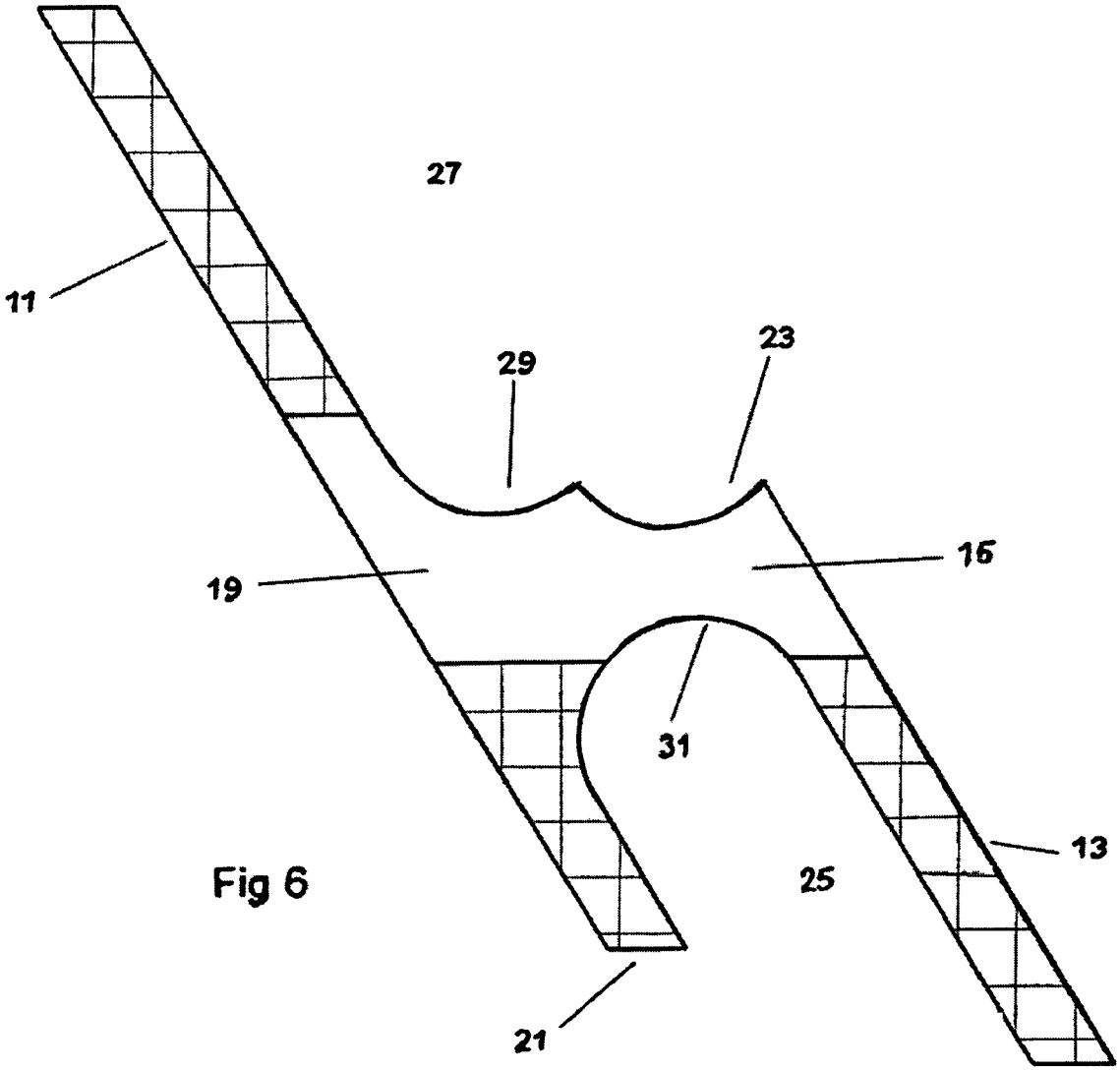
FIG. 6 is a perspective view, illustrating a side cross-sectional view of the baffle, according to an embodiment of the present invention of FIG. 1.

Referring now to FIGS. 2-6 showing perspective views, illustrating a rear face view of baffle 3 in FIG. 2, a front face view of baffle 3 in FIG. 3, a rear face perspective view of baffle 3 in FIG. 4, another front face perspective view of baffle 3 in FIG. 5, and FIG. 6 shows a perspective view, illustrating a side cross-sectional view of baffle 3, according to an embodiment of the present invention of FIG. 1.

Figure 7:
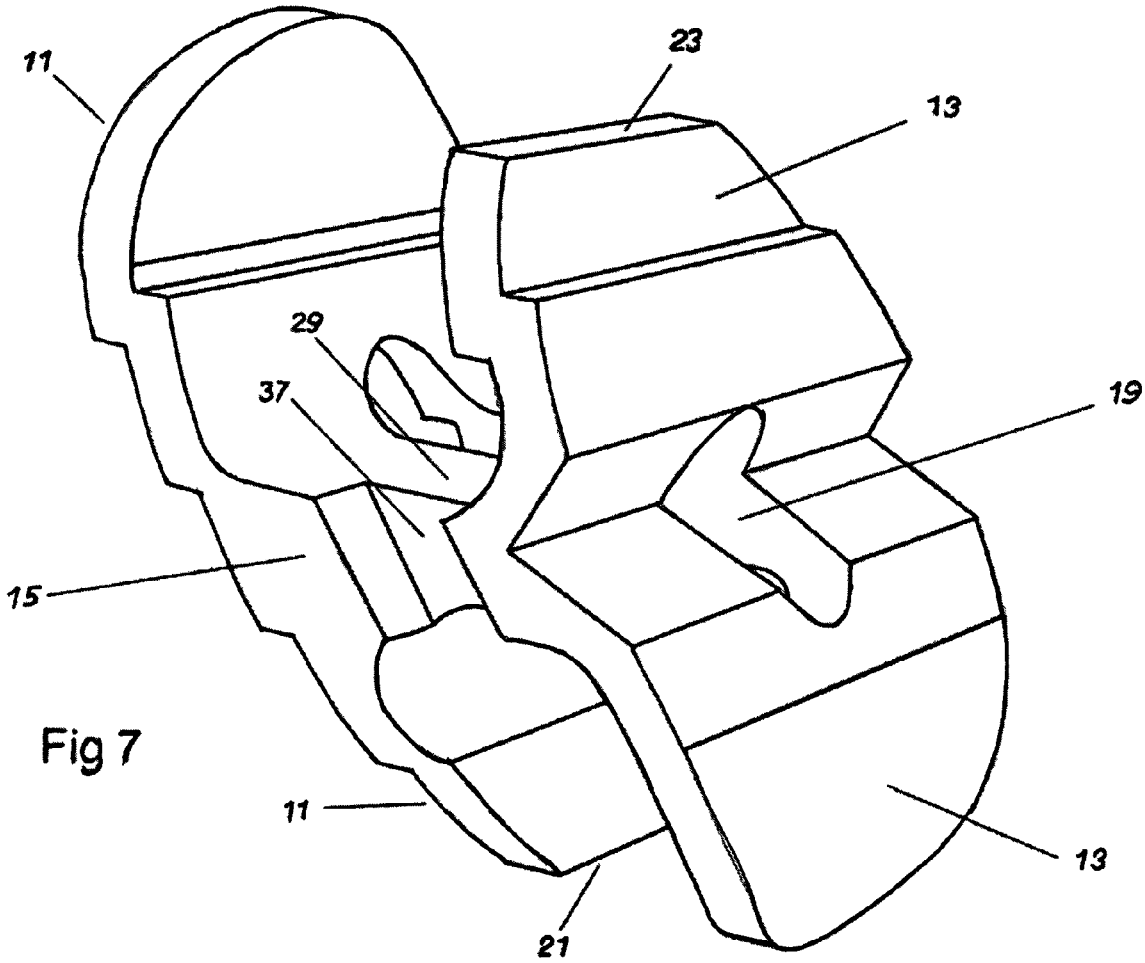
FIG. 7 is a front face perspective view of another embodiment of the baffle showing gas ports in the curvilinear joining wall of the baffle.

Baffle 3 has proximal face 11 and distal face 13. The two faces 11 and 13 may joined by a curvilinear joining wall 15 that may be shaped like those shown in FIGS. 4-6 or as shown in FIG. 7. The curvilinear joining wall 15 may have a plurality of openings that vent gases from the bore 19 of baffle 3. Proximal face 11 and distal face 13 may have cut-off chords 21 and 23 respectively, as shown in FIGS. 2 and 3. Between the two faces 11 and 13 may be two expansion chambers 25 and 27. These expansion chambers 25 and 27 are defined by housing 1 and upper and lower surfaces 29 and 31 respectively, of curvilinear wall 15. Curvilinear joining wall 15 may be formed through the removal of material between the two faces 11 and 13. Curvilinear joining wall 15 may also be formed by machining, casting, injection molding or other suitable method from bar stock. In another embodiment the present invention may be formed from square billet and fastened to a flat plate to enclose the open side after the machining process, as referred to in FIG. 13. The present invention may alternately be machined as a monocore.

While FIGS. 2-6 show the use of a curvilinear joining wall 15 to join the proximal and distal faces 11 and 13 respectively, other alternate embodiments of the baffle element 3 may use a stepped curvilinear joining wall 15, a planar joining wall or a joining wall that has angled surfaces to join the two faces of the baffle element together. The wall joining the two faces 11 and 13 of baffle 3 together may be positioned eccentrically to the bore, or it may be alternatively positioned parallel to bore 19, this being dependent upon the shape of the wall. Cut-off chords 21 and 23 are confined to the front and rear curvilinear walls. An inner volume is defined between the front and rear curvilinear walls 15 subsequent the machining process. If the planar joining wall is parallel to bore 19, then gas vents 33 may be machined into the planar joining wall to vent gas from the bore 19 into the two expansion chambers 25 and 27.

Figure 8:
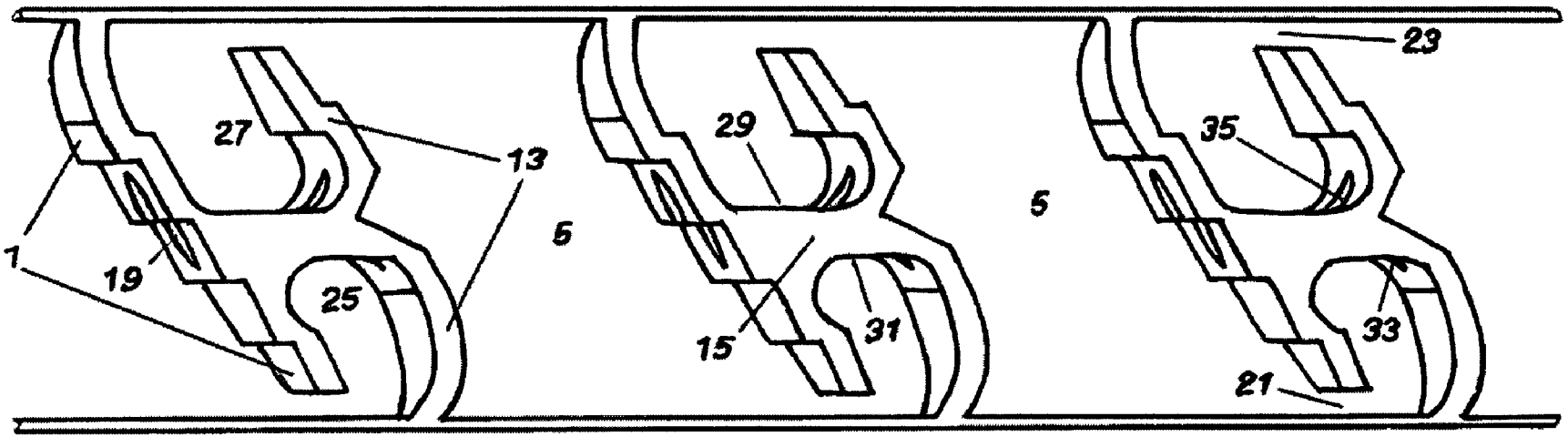
FIG. 8 shows a side view of a monolithic or mono-bloc construction of the baffle stack using another embodiment of the invention.

Baffles 3, as shown in FIGS. 1-6 may have the curvilinear section positioned eccentrically to the bore. With the curvilinear joining wall 15 being positioned eccentrically to bore 19, this may result in sections of the bore hole being cut away, thus forming openings such as gas vent(s) 33 and opening 35. The eccentric positioning of the curvilinear joining wall 15 in relation to bore 19 of baffle 3 may result in a larger section of bore 19 being cut away on one side while the opposing side may have a smaller section. FIG. 6 shows in detail how the eccentrically positioned curvilinear joining wall 15 relates to a concentrically positioned bore 19 hole, and how the position of the section affects the size of gas vents 33 as shown in FIG. 8. While the proximal 11 and distal 13 faces of baffle 3 are shown as being curvilinear stepped, it should be understood that either the proximal 11, the distal 13 or both proximal 11 and distal faces 13 may be curvilinear, asymmetric or flat. Sections of the proximal 11 and distal faces 13 may also be curved or bent either forward or backward depending upon the shape of the proximal 11 and distal faces 13. The curve and/or bend may occur at any position from the center of bore 19 to the top or bottom outside edge of the face.

Referring now to FIG. 7 showing a front face perspective view of another embodiment of baffle 3 showing additional opening(s) 37 in curvilinear joining wall 15 of the baffle 3. Additional opening 37 may be provided in curvilinear joining wall 15 if so desired to create additional gas flow streams between the expansion chambers 25 and 27. The openings may be also used with a curvilinear stepped joining wall, a planar joining wall parallel to bore 19 or with an eccentrically positioned planar joining wall or a joining wall that has angled surfaces to create additional gas flow streams from expansion chamber 25 to expansion chamber 27. If the planar joining wall is positioned parallel to bore 19 of baffle 3, there may be only one opening 35 (as shown in FIG. 8) which is used to vent gas from bore 19 into expansion chamber 27. Additional openings 37 may be used to enable gas flow from expansion chamber 25 into expansion chamber 27. The creation of additional gas streams into expansion chamber 27 enhances the flow away from bore 19 of the suppressor.

Referring now to FIG. 8 showing a side view of a monolithic or mono-bloc construction of baffle stack using another embodiment of the invention. Using this form of construction, the baffle stack may be machined from solid metal or may be formed by welding, fastening, securing or fixing baffles to each other. Various means known to those skilled in the art such as tie rods or support straps may be used to form expansion chambers with baffles 3 in a spaced relationship.

Figure 9:
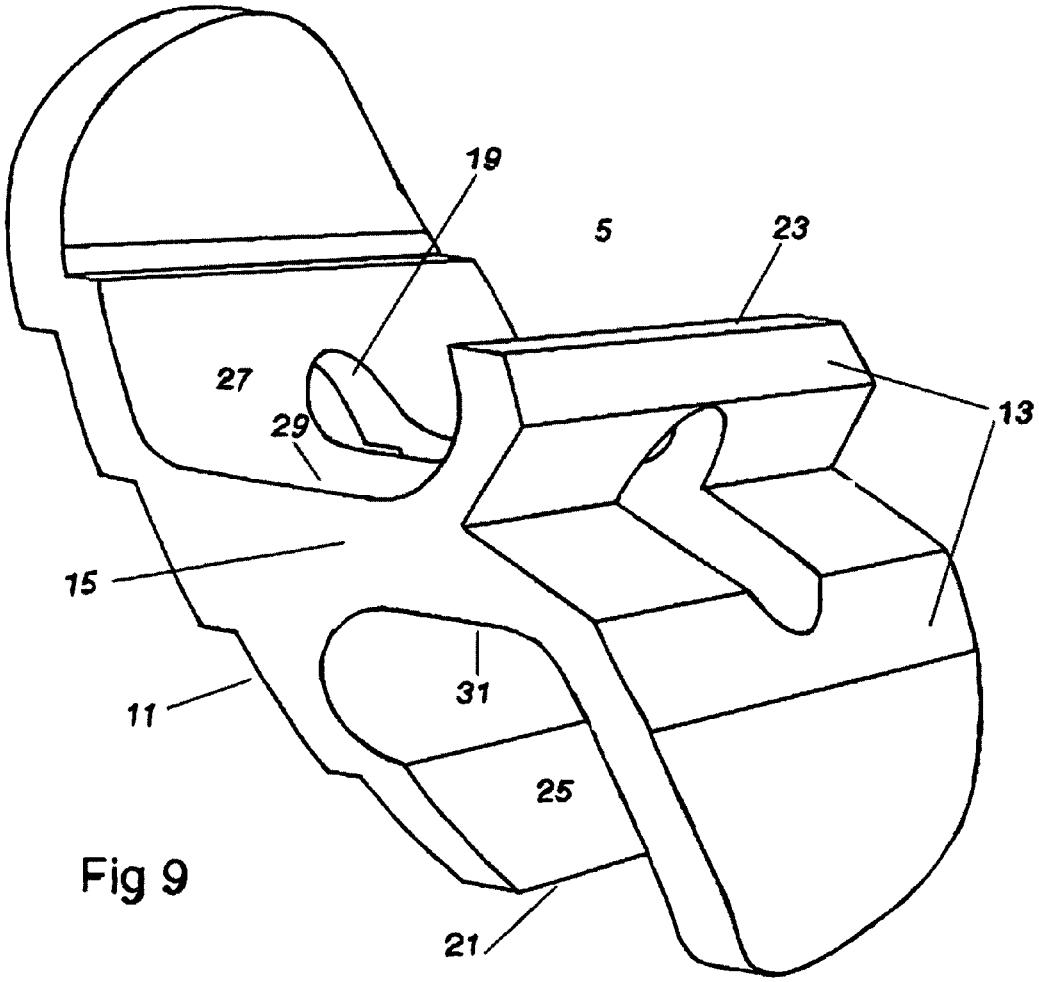
FIG. 9 shows a front face perspective view of an alternate embodiment of the baffle showing a large cut-off chord on the distal face of the baffle.
Figure 10:
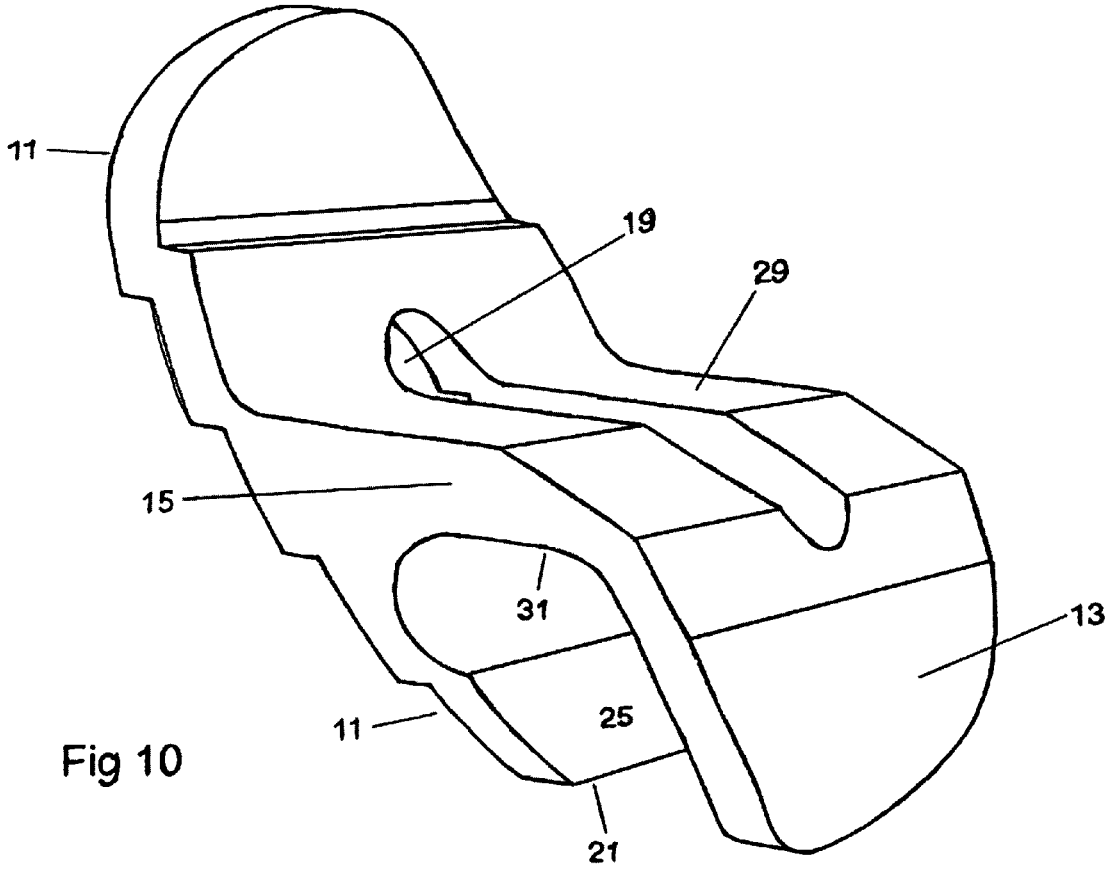
FIG. 10 shows a side perspective view of an alternate embodiment of the baffle showing a major cut-off chord on the distal face of the baffle.
Figure 10A:
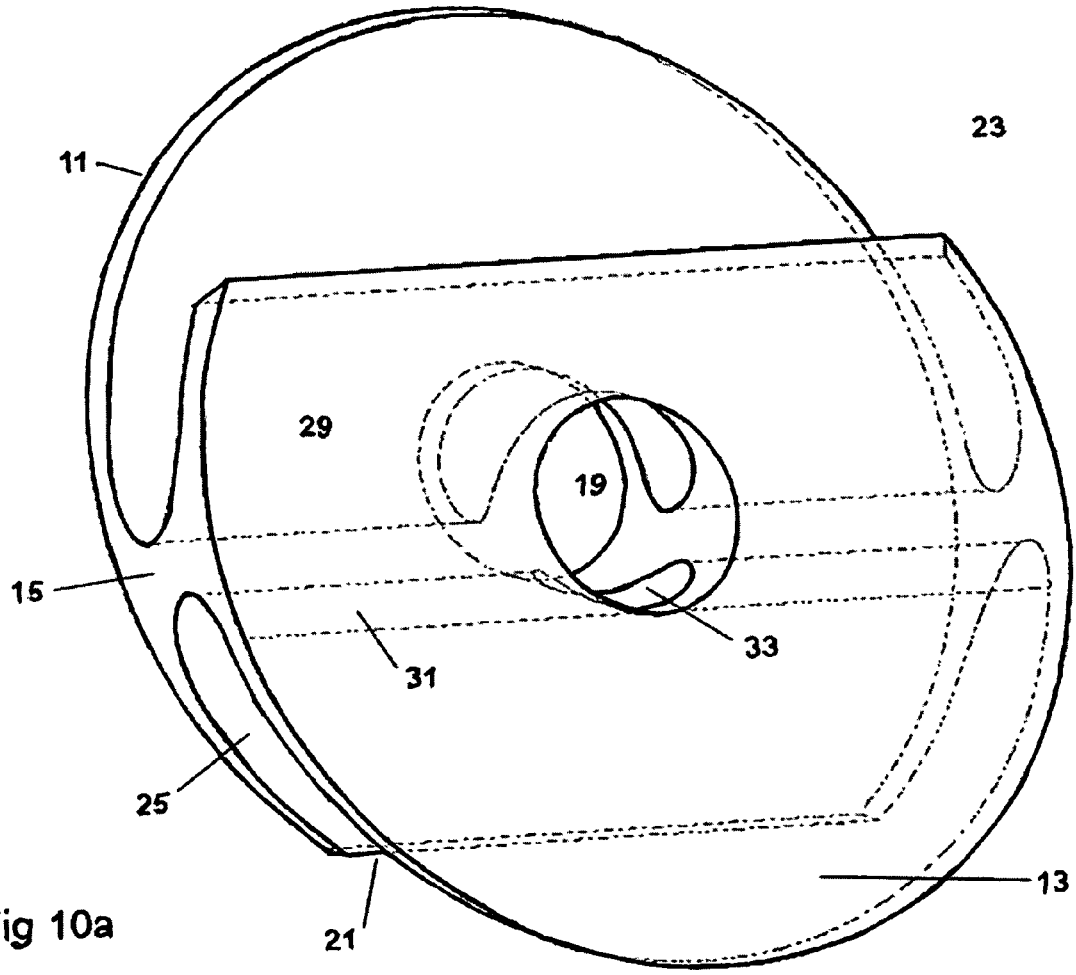
FIG. 10*a* shows a front perspective view of an alternate embodiment of the baffle showing a major cut-off chord on the distal face of the baffle.

Referring now to FIGS. 9 and 10 showing a front face perspective view of an alternate embodiment of baffle 3 showing a large cut-off chord 23 on distal face 13 of baffle 3. In this alternate embodiment, distal face 13 is modified by the removal of a large section of distal face 13 above the curvilinear joining wall 15. As a result of the removal of a section of distal face 13, the gas flows may be changed drastically. Expansion chamber 25 is enlarged and gas flowing through cut-off chord 21 on the proximal face 11 flows forward into an enlarged expansion chamber 5. The top section of bore 19 is now fully open and gas flows upward from the open bore 19 into the enlarged expansion chamber 5. Opening 35 remains positioned in the curvilinear joining wall 15 to vent gases into expansion chamber 27 and then forward into expansion chamber 5. With this alternate embodiment, the curvilinear joining wall 15 may still be positioned parallel or eccentrically to bore 19 of baffle 3.

In operation, suppressor utilizes the various features of the design to form multiple gas flows. Cut-off chords 21 and 23 on the two faces of baffle 3, and the two expansion chambers 25 and 27 in combination with the curvilinear joining wall 15 determine gas flows in relation to baffle 3. The cut-off chord 21 on proximal face 11 allows gas flow forward into expansion chamber 25 which in turn is augmented by gas flow from gas vent 33. This mixing together of the two gas flows creates turbulence and subsequent delaying of the forward passage of the gases. Gas flows through opening 35 into expansion chamber 27 and cut-off chord 23 allows for the forward flow of gas from expansion chamber 27 into one of the expansion chambers 5. Diverting gas away from bore 19 also assists in delaying gas flow and slows the expansion of gases within the suppressor, which in turn reduces noise generated when a firearm attached to the suppressor is fired.

While cut-off chords 21 and 23 allow for forward flow of gases into the expansion chambers 25 and 5, other forms of openings such as opening 35 may be used to achieve the same required gas flows. What is required is that the forward flow of gases be directed away from the center axis of bore 19 of the baffle 3 and the suppressor itself. The forward flow of lower pressure gases from expansion chamber 27 into expansion chamber 5 aids in this diversion of gases away from the center axis of bore 19.

Baffles 3, as described, offer great versatility by being able to be tuned for specific calibers and pressures. Varying certain and/or specific features of baffles 3 have resulted in baffles 3 having a capability to be tuned according to the bullet caliber and the associated gas pressures. In this manner the present invention offers tunability thereby allowing versatility in use.

Figure 9A:
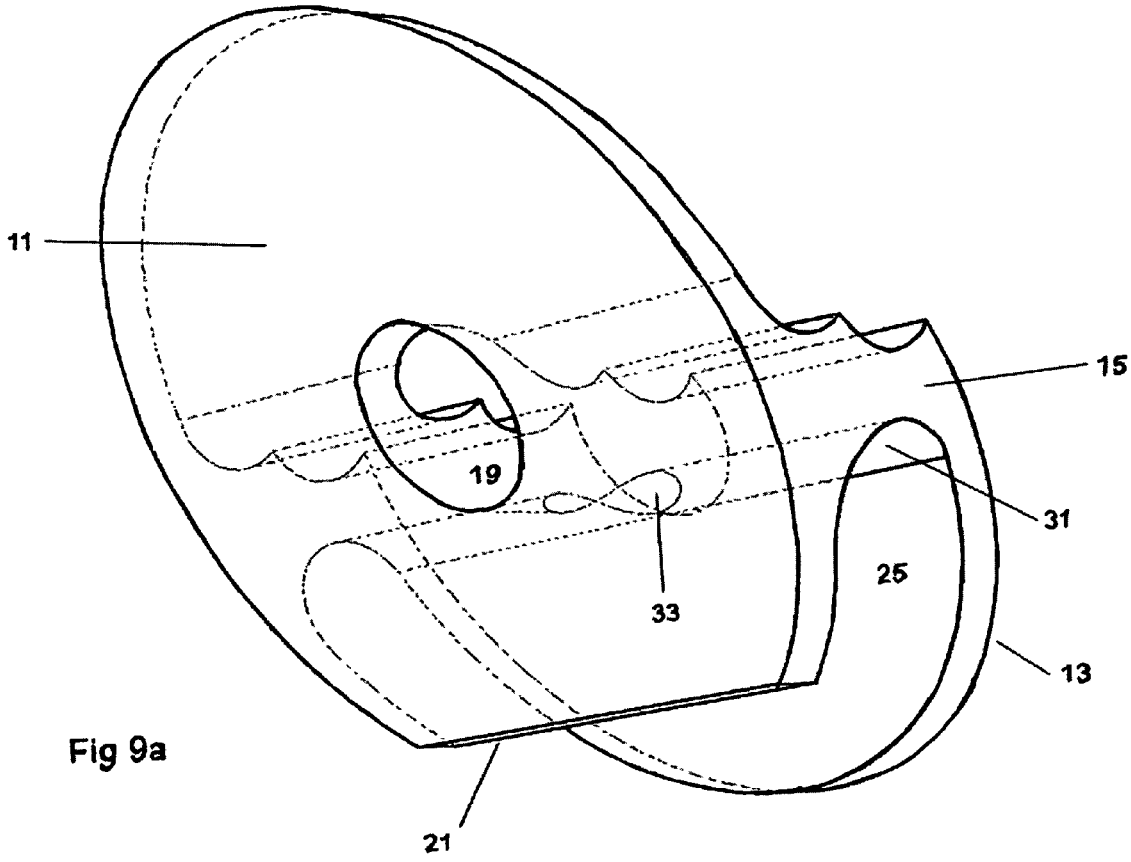
FIG. 9*a* shows another front face perspective view of an alternate embodiment of the baffle.
Figure 9B:
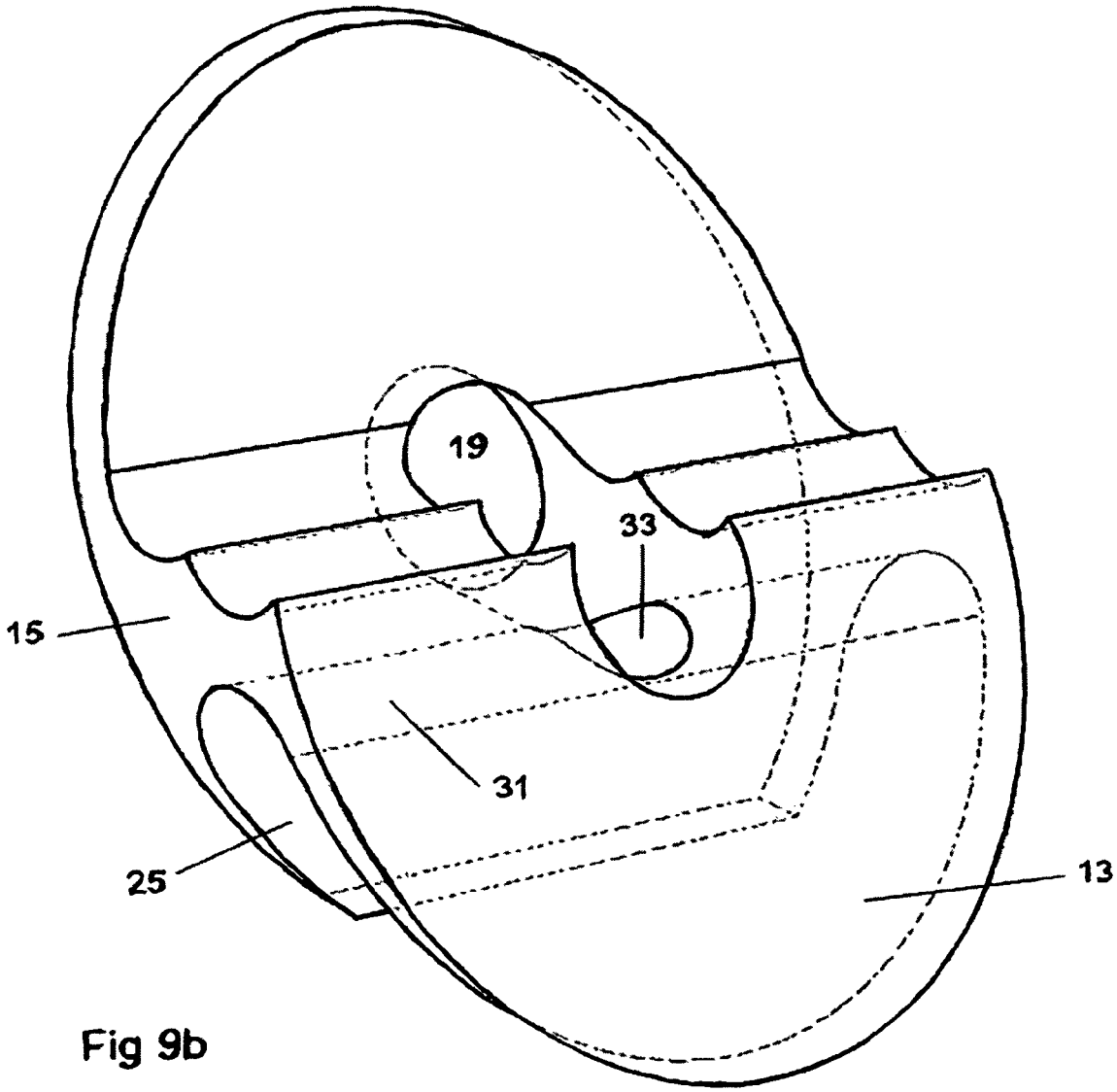
FIG. 9*b* shows another front face perspective view of the baffle of FIG. 9*a*.

Referring now to FIGS. 9*a* and 9*b* showing a front face perspective view of an alternate embodiment of baffle 3, wherein proximal face 11 and distal face 13 may be curved as shown in FIG. 9*a* and/or substantially flat as shown in FIG. 9*b*. The substantially perpendicular relation between bore 19 and gas vent 33 is also illustrated within the present figures. When compared with the embodiment of FIG. 9, it should be noted that proximal face 13 of the present embodiment comprises no stepped face portions, rather smoother edges which comprise less material and surface area providing a reduction in weight for the suppressor. This particular embodiment provides a means whereby smoother gas flow is permitted. The various designs can be incorporated into the suppressor using the differently designed contours at various distances from one another and from entrance end cap 7 and exit end cap 9. This variability may be used to create the desired sound suppression according to the weapon and the user's preference. In this way the present invention is tunable and versatile in use. Further, this provides that a suppressor can be custom built to provide adequate suppression for more than one firearm.

Figure 10B:
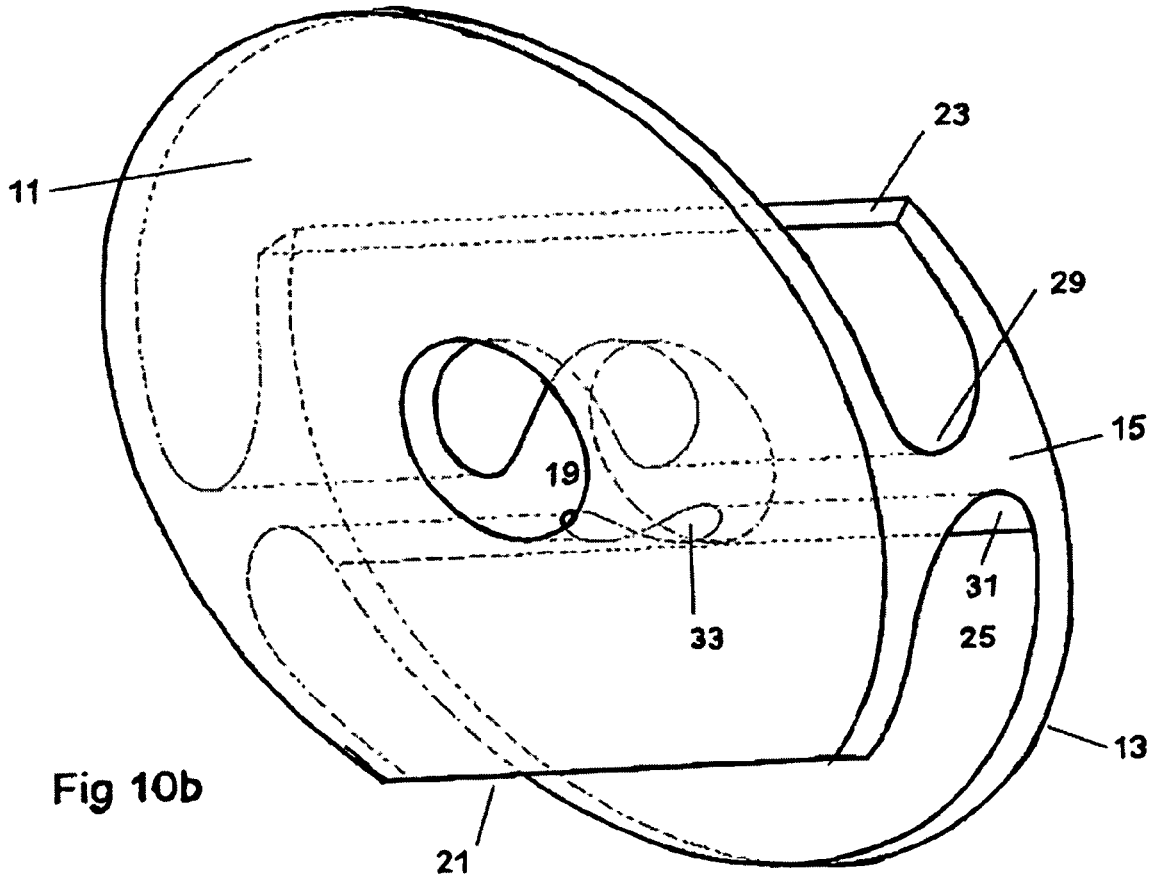
FIG. 10*b* shows a front perspective view of an alternate embodiment of the baffle showing a major cut-off chord on the distal face of the baffle.
Figure 11A:
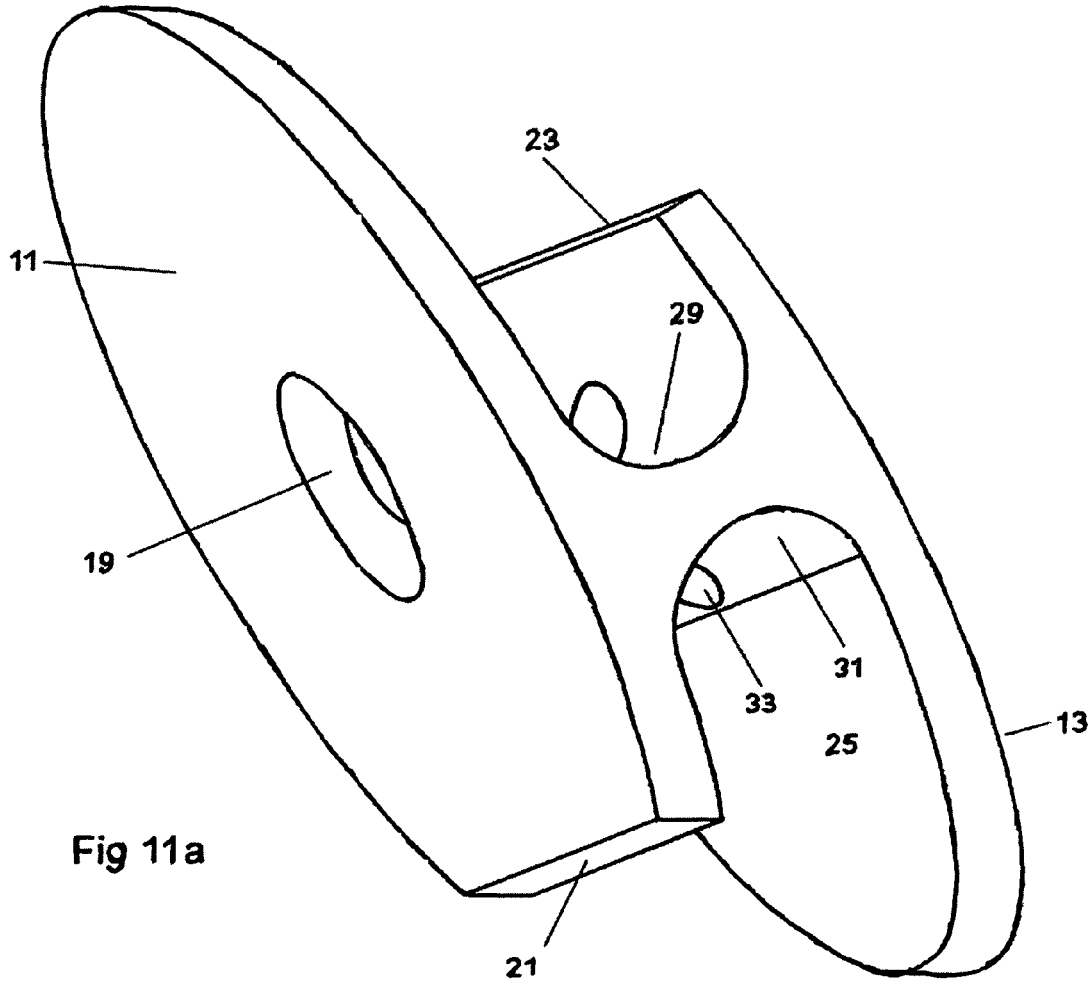
FIG. 11*a* shows a side perspective view of an alternate embodiment of the baffle showing a major cut-off chord on the distal face of the baffle.
Figure 11B:
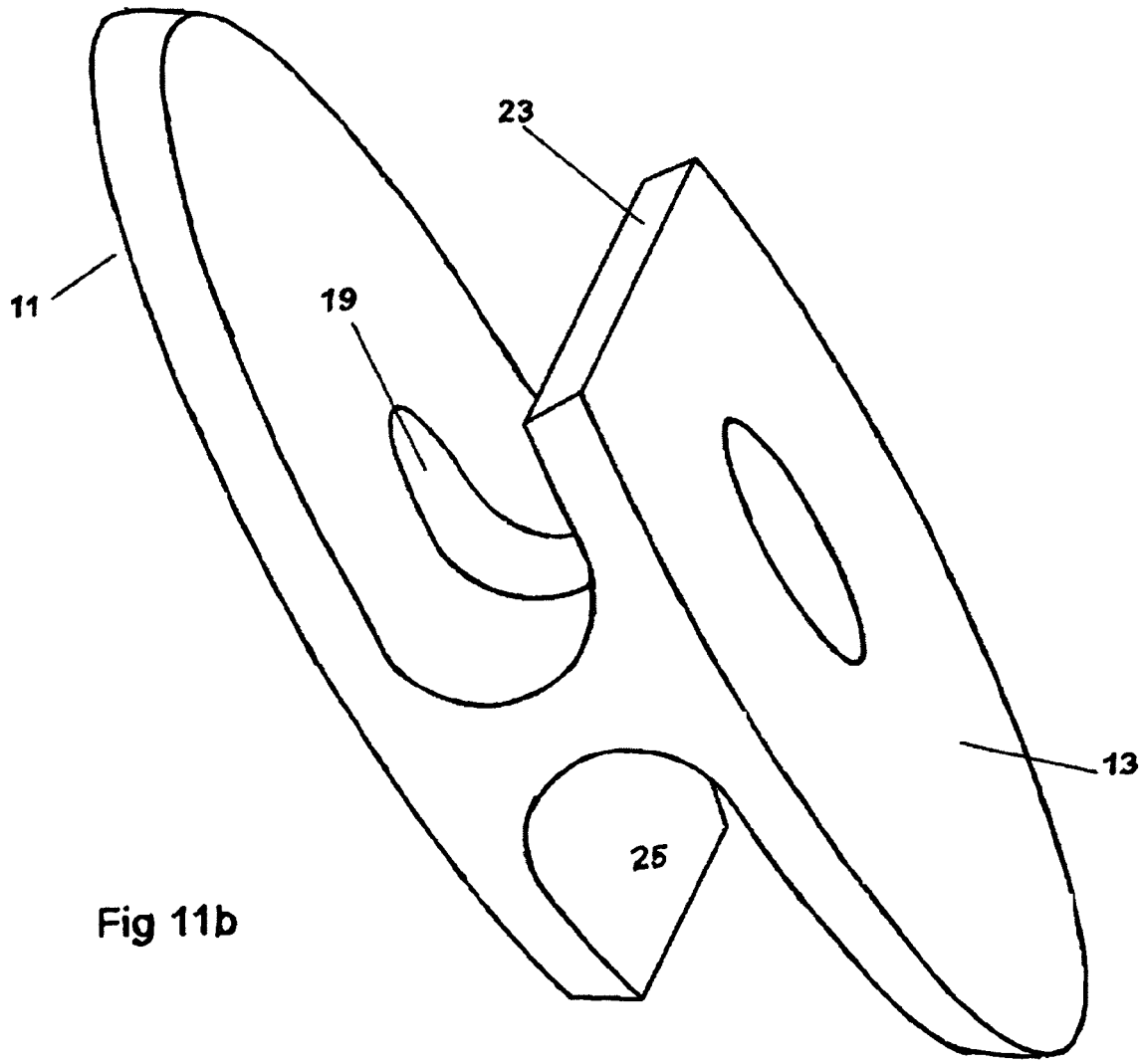
FIG. 11*b* shows a side perspective view of an alternate embodiment of the baffle showing a major cut-off chord on the proximal face of the baffle.

Referring now to FIGS. 10*a*, 10*b*, 11*a* and 11*b* showing front perspective views of an alternate embodiment of baffle 3 showing major cut-off chords 23 and 21, respectively on distal face 13 and proximal face 11 of baffle 3. As shown, the length, contour and surface area of distal face 13 and proximal face 11 may be altered. In direct relation expansion chambers 25 and 27 may be increased or decreased in volume. Angle of distal face 13 and proximal face 11 may also be changed as illustrated in FIGS. 10*b*, 11*a* and 11*b*. The angle of faces 11 and 13 may range from vertically parallel to slanted at an incline less than perpendicular relative to housing 1. Baffles 3 are at an angle to bore 19 and baffle 3 angles may vary within a single suppressor. Different discrete angles may also be used to provide the desired suppression, for example if the suppressor has five baffles 3, each of the five baffles 3 may be on its own angle relative to bore 19, some many be on different angles than others or all may be on the same angle relative to bore 19, allowing the desired suppressive effect to be attained. Bore 19 and gas vent 33 may also comprise different size diameters to accommodate different bullets and gas may be driven across instead of down bore 19. In this way the suppressor may either incorporate a larger total suppressor volume, or a lesser volume with more baffles 3. Cut off cords 21 and 23 size and shape may also be varied according to user preference and application. To achieve maximum effectiveness, the suppressor may be "tuned" for a specific cartridge/barrel length combination. This can be done through the use of either a fixed or adjustable baffle 3 design, as described previous.

Figure 12A:
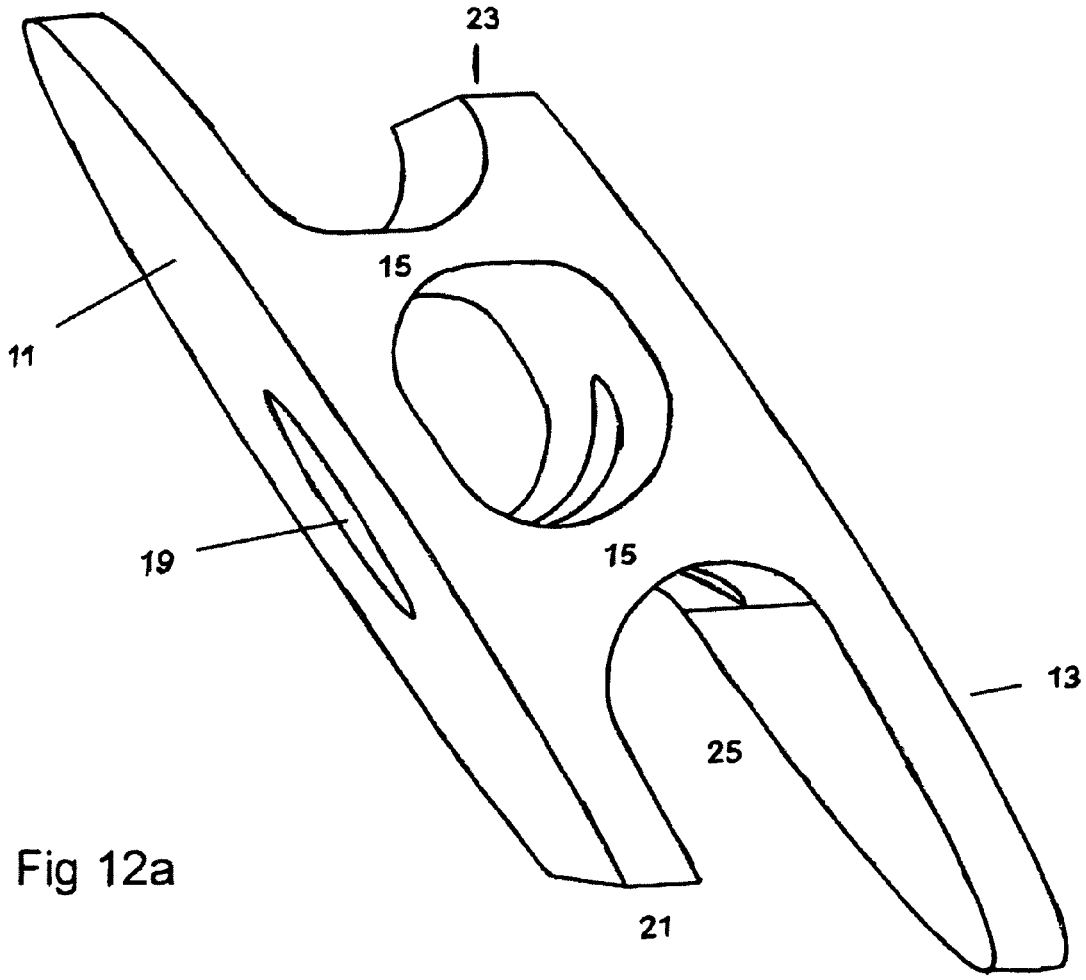
FIG. 12*a* is a side perspective view of an alternate embodiment of the baffle showing an additional joining wall.
Figure 12B:
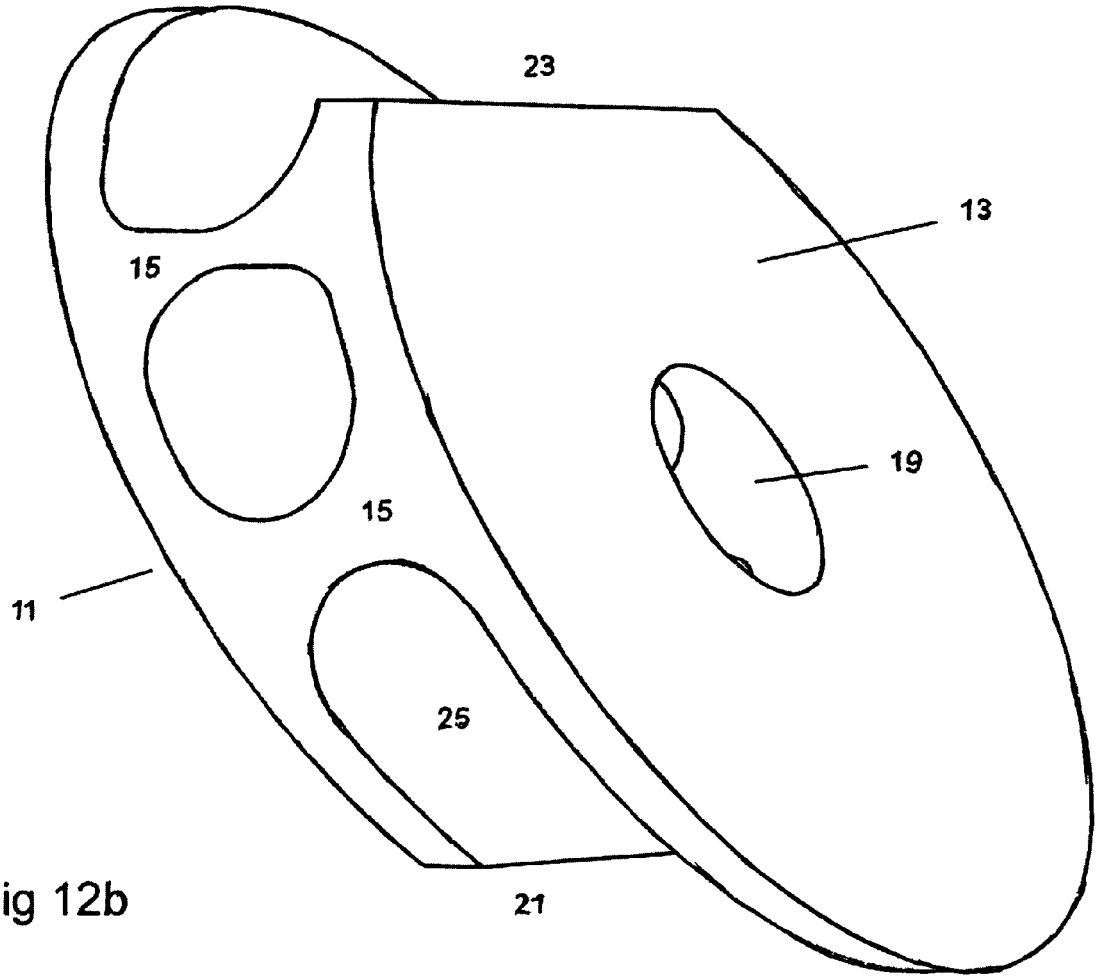
FIG. 12*b* is a side perspective view of an alternate embodiment of the baffle showing an additional joining wall.

Baffles 3 may be shaped to divert the propellant gases effectively into the expansion chambers 5, 25 and/or 27 according to which weapon the suppressor is to be used with. This shaping may comprise a slanted flat surface, canted at an angle to the bore, or a curved surface. The position of baffles 3 may be rotated around the axis of the bore throughout the suppressor. Baffles 3 may also have more than one joining wall 15 to provide for additional expansion chambers between proximal face 11 and distal face 13 as is shown in FIGS. 12*a* and 12*b*. Additional expansion chambers, coupled with additional openings 35 in the additional joining wall will provide for gases to be briefly diverted or trapped inside the additional expansion chambers, thus providing additional sound reduction. The additional joining walls may be positioned above or below the joining wall with the bore hole and the additional joining walls may have the same shape as the joining wall with the bore hole or the shape may be different. As an example, the joining wall with the bore hole may be curvilinear while the additional joining wall may be planar or angled.

Baffles 3, within the present invention are typically manufactured from stainless steel, aluminum, titanium or alloys such as Inconel, and are either machined out of solid metal or stamped out of sheet metal. The materials may also be injection molded, cast or manufactured by other suitable means. It should be noted that the material in baffles 3 may comprise other suitable materials and that this disclosure is not intended to be limited by the named materials, rather that these have been used to illustrate and enable its construction and to limit undo experimentation. Further, baffles 3 may be concentric to the tube or offset (eccentric) within this particular design due to its structural stability. The design of the suppressor of the present invention minimizes cleaning and maintenance.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A firearm sound suppressor, comprising a housing with a longitudinal axis with a proximal end having means for attachment to a firearm and a distal end having an bore hole, and at least one baffle positioned between said ends, said baffle having a proximal face and a distal face, with at least one opening in said proximal face; at least one joining wall, said joining wall being positioned between the proximal face and the distal face and forming expansion chambers between said faces; the proximal face, the distal face and the at least one joining wall having a bore hole there through; said joining wall having at least one opening from said bore hole through said joining wall, said joining wall having at least one opening in said wall into at least one of the said expansion chambers and wherein the joining wall is either planar, curvilinear, stepped curvilinear or angled.

2. A firearm sound suppressor of claim 1, wherein said at least one face of the baffle is either flat, curvilinear, curvilinear stepped, or asymmetrical to the axis of the baffle.

3. A firearm sound suppressor of claim 1, wherein said distal face of the baffle has at least one opening in said distal face.

4. A firearm sound suppressor of claim 1, wherein said proximal and distal faces are either flat, curvilinear, curvilinear stepped, or asymmetrical to the axis of the baffle.

5. A firearm sound suppressor as claimed for in claim 1, including a plurality of said baffles positioned between said ends and in a spaced relationship and a plurality of expansion chambers positioned between said ends and said baffles.

6. A firearm sound suppressor, comprising a housing with a longitudinal axis with a proximal end having means for attachment to a firearm and a distal end having an bore hole, and at least one baffle positioned between said ends, said baffle having a proximal face and a distal face, with at least one opening in said proximal face and at least one opening in said distal face; at least one joining wall, said joining wall being positioned between the proximal face and the distal face and forming expansion chambers between said faces; the proximal face, the distal face and the at least one joining wall having a bore hole there through; said joining wall having at least one opening from said bore hole through said joining wall, said joining wall having at least one opening in said wall into at least one of the said expansion chambers; wherein the joining wall is either planar, curvilinear, stepped curvilinear or angled and at least one face of said baffle is either flat, curvilinear, curvilinear stepped, or asymmetrical to the axis of the baffle.

7. A firearm sound suppressor as claimed for in claim 6, wherein said openings in said proximal and said distal faces are cut-off chords.

8. A firearm sound suppressor as claimed for in claim 6, wherein said proximal and distal faces are either flat, curvilinear, curvilinear stepped, or asymmetrical to the axis of the baffle.

9. A firearm sound suppressor as claimed for in claim 6, including a plurality of said baffles positioned between said ends and in a spaced relationship and a plurality of expansion chambers positioned between said ends and said baffles.

10. A firearm sound suppressor, comprising a housing with a longitudinal axis with a proximal end having means for attachment to a firearm and a distal end having an bore hole, and at least one baffle positioned between said ends, said baffle having a proximal face and a distal face, with at least one opening in said proximal face and at least one opening in said distal face; a plurality of joining walls, said joining walls being positioned between the proximal face and the distal face and forming expansion chambers between said faces; the proximal face, the distal face and one of said plurality of joining walls having a bore hole there through; said joining wall having the bore hole having at least one opening from the bore hole through the joining wall; said joining walls having at least one opening in said walls into said expansion chambers; and wherein said at least one of said joining walls is either planar, curvilinear, stepped curvilinear or angled and at least one face of said baffle is either flat, curvilinear, curvilinear stepped, or asymmetrical to the axis of the baffle.

11. A firearm sound suppressor as claimed for in claim 10, wherein said proximal and distal faces are either flat, curvilinear, curvilinear stepped, or asymmetrical to the axis of the baffle.

12. A firearm sound suppressor as claimed for in claim 10, wherein said openings in said proximal and said distal faces are cut-off chords.

13. A firearm sound suppressor as claimed for in claim 10, including a plurality of said baffles positioned between said ends and in a spaced relationship and a plurality of expansion chambers positioned between said ends and said baffles.

* * * * *